US006737569B2

(12) United States Patent
Kees

(10) Patent No.: US 6,737,569 B2
(45) Date of Patent: May 18, 2004

(54) PICK FOR A STRINGED MUSICAL INSTRUMENT

(76) Inventor: Charles Kees, P.O. Box 18183, Natchez, MS (US) 39122

( * ) Notice: Subject to any disclaimer, the term of this patent is extended or adjusted under 35 U.S.C. 154(b) by 57 days.

(21) Appl. No.: 09/683,928

(22) Filed: Mar. 4, 2002

(65) Prior Publication Data

US 2003/0164082 A1 Sep. 4, 2003

(51) Int. Cl.[7] ..... G10D 3/16
(52) U.S. Cl. ..... 84/322
(58) Field of Search ..... 84/322, 320, 321, 84/315, 316, 317, 318

(56) References Cited

U.S. PATENT DOCUMENTS

| | | | | | |
|---|---|---|---|---|---|
| 2,459,274 | A | * | 1/1949 | Galetzky | 84/320 |
| 3,442,169 | A | | 5/1969 | Bowers | |
| 3,648,558 | A | | 3/1972 | Chenette | |
| 4,102,234 | A | | 7/1978 | Brundage | |
| 4,270,433 | A | | 6/1981 | Adamec | |
| 4,625,616 | A | | 12/1986 | McVicker | |
| 4,867,032 | A | | 9/1989 | Lukehart | |
| 6,118,058 | A | * | 9/2000 | Rowley | 84/320 |
| D444,167 | S | * | 6/2001 | Charters | D17/20 |
| 6,259,009 | B1 | * | 7/2001 | Bolo, III | 84/329 |

* cited by examiner

*Primary Examiner*—Kimberly Lockett
(74) *Attorney, Agent, or Firm*—Christopher L. Bernard

(57) ABSTRACT

A pick device for playing a stringed musical instrument is taught. The pick device includes a center portion, wherein the center portion is configured to be positioned about a tip of a finger or thumb of a player in a ring-like configuration. The pick device also includes a head or first end portion coupled to the center portion, wherein the head portion is suitable for strumming and plucking/picking strings of the instrument, and a tail or second end portion coupled to the center portion. The pick device further includes a receiving slot disposed within the center portion, wherein the receiving slot is configured to adjustably receive the tail or second end portion. The player can rapidly transition between use of the head or first end portion and tail or second end portion when playing the instrument by repositioning the center portion about the tip of the finger or thumb.

23 Claims, 4 Drawing Sheets

PICK FOR A STRINGED MUSICAL INSTRUMENT

BACKGROUND OF INVENTION

1. Field of the Invention

The present invention relates generally to a pick for a stringed musical instrument. More specifically, the present invention relates to a pick for a stringed musical instrument that has a center portion configured to be positioned about the tip of a player's finger and one or two end portions, optionally including a thin head and a thick head, suitable for selectively strumming or plucking strings of the instrument.

2. Background Information

Players of stringed musical instruments, such as acoustic guitars, electric guitars, acoustic bass guitars, electric bass guitars, banjos, and the like, typically use a pick or plectrum to strum or pluck the strings of their instrument. A conventional pick or plectrum is typically a small, thin piece of plastic or another material having a generally triangular shape. The pick or plectrum is pressed between a player's thumb and their adjacent index finger, with a pointed end of the pick or plectrum extending downwardly to strum or pluck the strings of the instrument. The need to maintain constant pressure between the thumb and the index finger can be exceedingly fatiguing, particularly over long musical sets. The pick or plectrum can also be displaced, dislodged, or dropped.

To remedy these problems, a number of picks or plectrums have been designed with a ring-like portion configured to be positioned about the tip of a player's finger. In one example, a ring-like device configured to releasably and adjustably position a pick or plectrum in one of the habitually familiar playing positions relative to the fingers of a player. The pick or plectrum is secured to the ring-like device by a nut. In another example, a pick or plectrum fits about the finger of a player, with the position of the pick or plectrum maintained by an elastic band extending about the finger.

In a further example, a harness for securely holding a pick or plectrum in firm engagement with a player's thumb is taught. The harness consists of a simple, flexible, and resilient strap configured to fit about the thumb in advance of the player's first knuckle. The harness includes a central portion that is slit to receive and hold the pick or plectrum firmly against the undersurface of the thumb, with the pointed end of the pick or plectrum protruding through the slit into a playing position.

In yet another example, a pick or plectrum includes a ring-like element having a boss with a recess in the lower portion thereof that is dimensioned and configured to support therein a player's finger adjacent to that finger wearing the ring-like element. A stud element projects upwardly from the boss for mounting the pick thereon.

In one example, a thumb pick or plectrum is provided that has a an integral main, body portion that has straps for selectively defining a thumb-receiving passageway. Finally, in another example, a pick or plectrum is self-secured to a player's thumb, and can be utilized in either an upstroke or a downstroke without the aide of another finger. The tip that strokes the string is secured to the band that fits around the thumb by inserting it into a slot.

Although various of the above-described pick or plectrum designs reduce the likelihood of displacing, dislodging, or dropping the pick or plectrum while playing an instrument, none are properly and automatically positioned with respect to a player's fingers, none allow for a rapid change in rigidity, and none become unobtrusive or "float" during finger picking. Further, none of the picks or plectrums have a head that can be adequately customized with respect to shape. Thus, what is needed is a pick or plectrum that is properly and automatically positioned with respect to a player's fingers, that allows for a rapid change in rigidity, and that becomes unobtrusive or "floats" during finger picking. Further, what is needed is a pick or plectrum that has a head that can be adequately customized with respect to shape. Accordingly, the pick or plectrum should be able to be cut without splitting or cracking.

SUMMARY OF INVENTION

The present invention provides a pick that remedies the above-described problems. In addition, the pick of the present invention can be positioned about the tip of any finger, requires a relatively low pressure to hold, allows for a rapid transition between strumming or plucking and finger picking, and can be attached to the strings of an instrument when not in use. The pick of the present invention also has an adjustable flex point, providing consistent pick-to-string contact, and can be made of a self-lubricating material, providing relatively low string wear and relatively high pick life. These and other advantages and features of the pick of the present invention will be described in greater detail herein below.

In one embodiment of the present invention, a pick device for playing a stringed musical instrument includes a center portion, wherein the center portion is configured to be positioned about a tip of a finger of a player in a ring-like configuration. The pick device also includes a head portion coupled to the center portion, wherein the head portion is suitable for strumming and plucking/picking strings of the instrument, and a tail portion coupled to the center portion. The pick device further includes a receiving slot disposed within the center portion, wherein the receiving slot is configured to adjustably receive the tail portion.

In another embodiment of the present invention, a pick device for playing a stringed musical instrument includes a center portion, wherein the center portion is configured to be positioned about a tip of a thumb of a player in a ring-like configuration. The pick device also includes a first end portion coupled to the center portion, wherein the first end portion is suitable for strumming and plucking/picking strings of the instrument, and a second end portion coupled to the center portion, wherein-the second end portion is suitable for strumming and plucking/picking strings of the instrument. The pick device further includes a receiving slot disposed within the center portion, wherein the receiving slot is configured to adjustably receive the first end portion. The player can rapidly transition between use of the first end portion and the second end portion when playing the instrument by repositioning the center portion about the tip of the thumb.

DETAILED DESCRIPTION

Figure 1:
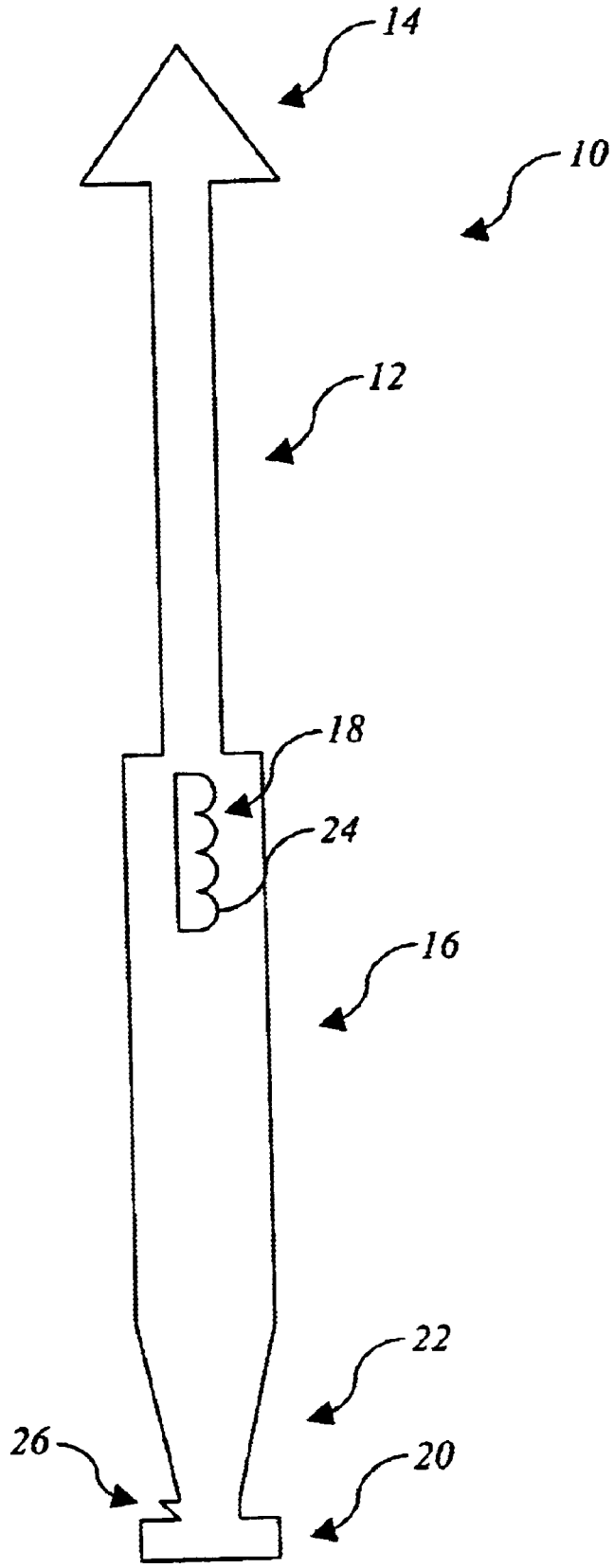
FIG. 1 is a top view of one embodiment of the pick of the present invention for use as a floating pick.

Referring to FIG. 1, in one embodiment of the present invention, the floating pick 10 has a first elongate portion 12, including a head portion 14. The head portion 14 has a rigidity that makes it especially suitable for strumming and/or plucking/picking the strings of an instrument. The head portion 14 has a substantially triangular shape, although another suitable shape can be utilized. The shape of the head portion 14 preferably contributes to its rigidity. The head portion 14 can have a substantially uniform thickness or, alternatively, can taper along its length and/or width. The first elongate portion 12 has a substantially rectangular shape, although another suitable shape can be utilized.

The floating pick 10 also has a second elongate portion 16 that has a substantially rectangular shape, although another suitable shape can be utilized. The second elongate portion 16 is configured to be positioned about the tip of a player's finger and, accordingly, includes a receiving slot 18. The receiving slot 18 is operable for receiving a tail portion 20 of the floating pick 10, forming a ring-like portion (not shown) configured to be positioned about the tip of the player's finger. The tail portion 20 has a substantially rectangular shape, although another suitable shape can be utilized. A tapering portion 22 of the floating pick 10, disposed between the second elongate portion 16 and the tail portion 20, is preferably sufficiently flexible that the tail portion 20 can be twisted or cammed and inserted in and through the receiving slot 18. Preferably, the tapering portion 22 tapers width-wise from the second elongate portion 16 to the tail portion 20. The receiving slot 18 includes a plurality of notches 24, allowing the diameter or size of the ring-like portion to be adjusted such that the ring-like portion can be positioned about the tip of any player's finger. The tail portion 20 includes a tab 26 operable for securing the tail portion 20 in the receiving slot 18. Advantageously, the configuration of the tail portion 20 and the receiving slot 18, and their engagement method, allow the ring-like portion to snugly engage any finger upon which the floating pick 10 is positioned when the strings of the instrument are strummed, plucked, or picked.

The first elongate portion 12, the head portion 14, the second elongate portion 16, and the tail portion 20 can be separate components fixedly attached to one another, or they may be integrally formed. The first elongate portion 12, the head portion 14, the second elongate portion 16, and the tail portion 20 can be made of plastic, metal, or any other suitable material. Optionally, the first elongate portion 12, the head portion 14, the second elongate portion 16, and the tail portion 20 can be made of a self-lubricating material. The first elongate portion 12, the head portion 14, the second elongate portion 16, and the tail portion 20 can have a thickness of between about 0.01 inches and 0.10 inches, however, other suitable dimensions can be utilized.

Advantageously, the ring-like portion of the floating pick 10 allows the floating pick 10 to be held with a relatively low pressure. The ring-like portion also allows the floating pick 10 to be attached to the strings of an instrument when not in use, such that it will not be lost. The floating pick 10 has an adjustable flex point, providing consistent pick-to-string contact, and can be made of a self-lubricating material, providing relatively low string wear and relatively high pick life. Optionally, a conventional pick or plectrum can be fixedly attached to the head portion 14 of the floating pick 10.

Figure 2:
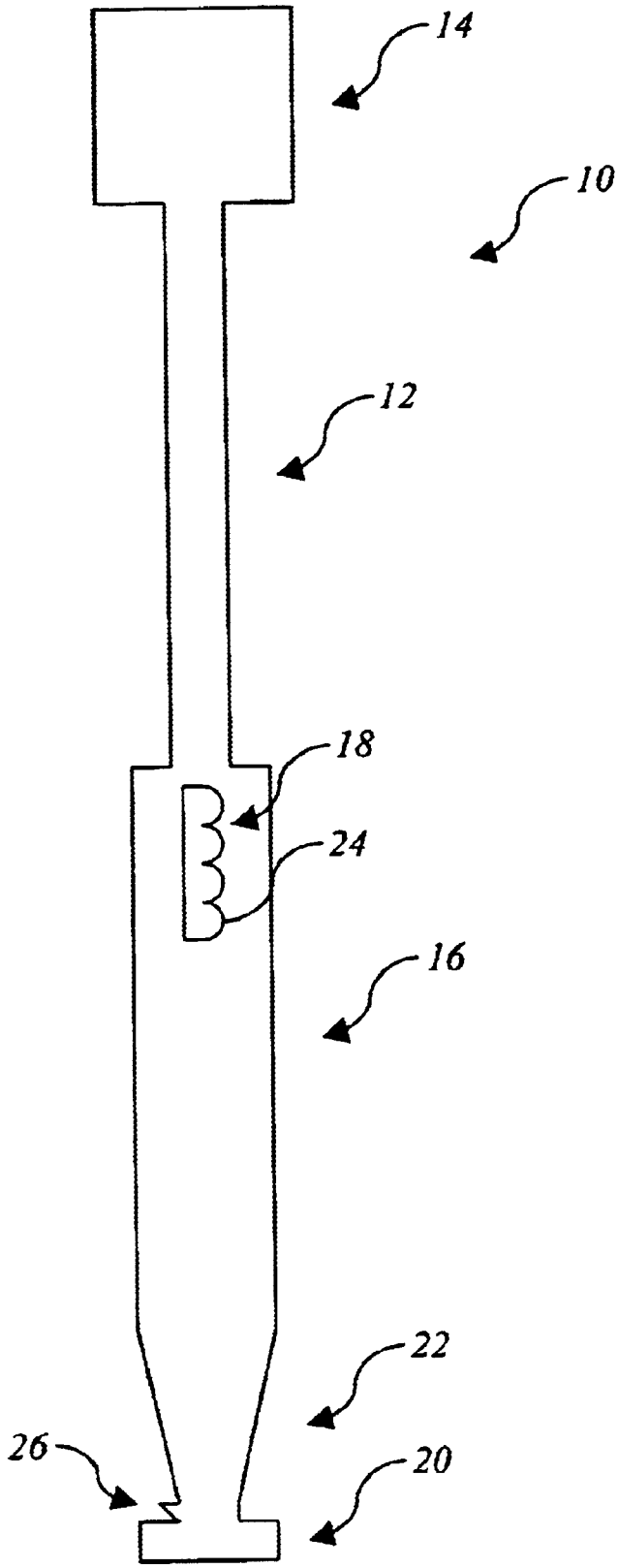
FIG. 2 is a top view of another embodiment of the pick of the present invention for use as a floating pick.

Referring to FIG. 2, in another embodiment of the present invention, the floating pick 10 has a first elongate portion 12, including a head portion 14. The head portion 14 has a rigidity that makes it especially suitable for strumming and/or plucking/picking the strings of an instrument. The head portion 14 has a substantially rectangular shape, although another suitable shape can be utilized. The head portion 14 can have a substantially uniform thickness or, alternatively, can taper along its length and/or width. Advantageously, the head portion 14 can be trimmed by a player or customized with respect to shape. The eventual shape of the head portion 14 preferably contributes to its rigidity.

The floating pick 10 also has a second elongate portion 16 that has a substantially rectangular shape, although another suitable shape can be utilized. The second elongate portion 16 is configured to be positioned about the tip of a player's finger and, accordingly, includes a receiving slot 18. The receiving slot 18 is operable for receiving a tail portion 20 of the floating pick 10, forming a ring-like portion (not shown) configured to be positioned about the tip of the player's finger. The tail portion 20 has a substantially rectangular shape, although another suitable shape can be utilized. A tapering portion 22 of the floating pick 10, disposed between the second elongate portion 16 and the tail portion 20, is preferably sufficiently flexible that the tail portion 20 can be twisted or cammed and inserted in and through the receiving slot 18. Preferably, the tapering portion 22 tapers width-wise from the second elongate portion 16 to the tail portion 20. The receiving slot 18 includes a plurality of notches 24, allowing the diameter or size of the ring-like portion to be adjusted such that the ring-like portion can be positioned about the tip of any player's finger. The tail portion 20 includes a tab 26 operable for securing the tail portion 20 in the receiving slot 18. Advantageously, the configuration of the tail portion 20 and the receiving slot 18, and their engagement method, allow the ring-like portion to snugly engage any finger upon which the floating pick 10 is positioned when the strings of the instrument are strummed, plucked, or picked.

The first elongate portion 12, the head portion 14, the second elongate portion 16, and the tail portion 20 can be separate components fixedly attached to one another, or they may be integrally formed. The first elongate portion 12, the head portion 14, the second elongate portion 16, and the tail portion 20 can be made of plastic, metal, or any other suitable material. Optionally, the first elongate portion 12, the head portion 14, the second elongate portion 16, and the tail portion 20 can be made of a self-lubricating material. The first elongate portion 12, the head portion 14, the second elongate portion 16, and the tail portion 20 can have a thickness of between about 0.01 inches and 0.10 inches, however, other suitable dimensions can be utilized.

As described above, the ring-like portion of the floating pick 10 allows the floating pick 10 to be held with a relatively low pressure. The ring-like portion also allows the floating pick 10 to be attached to the strings of an instrument when not in use, such that it will not be lost. Again, the floating pick 10 has an adjustable flex point, providing consistent pick-to-string contact, and can be made of a self-lubricating material, providing relatively low string wear and relatively high pick life.

Figure 3:
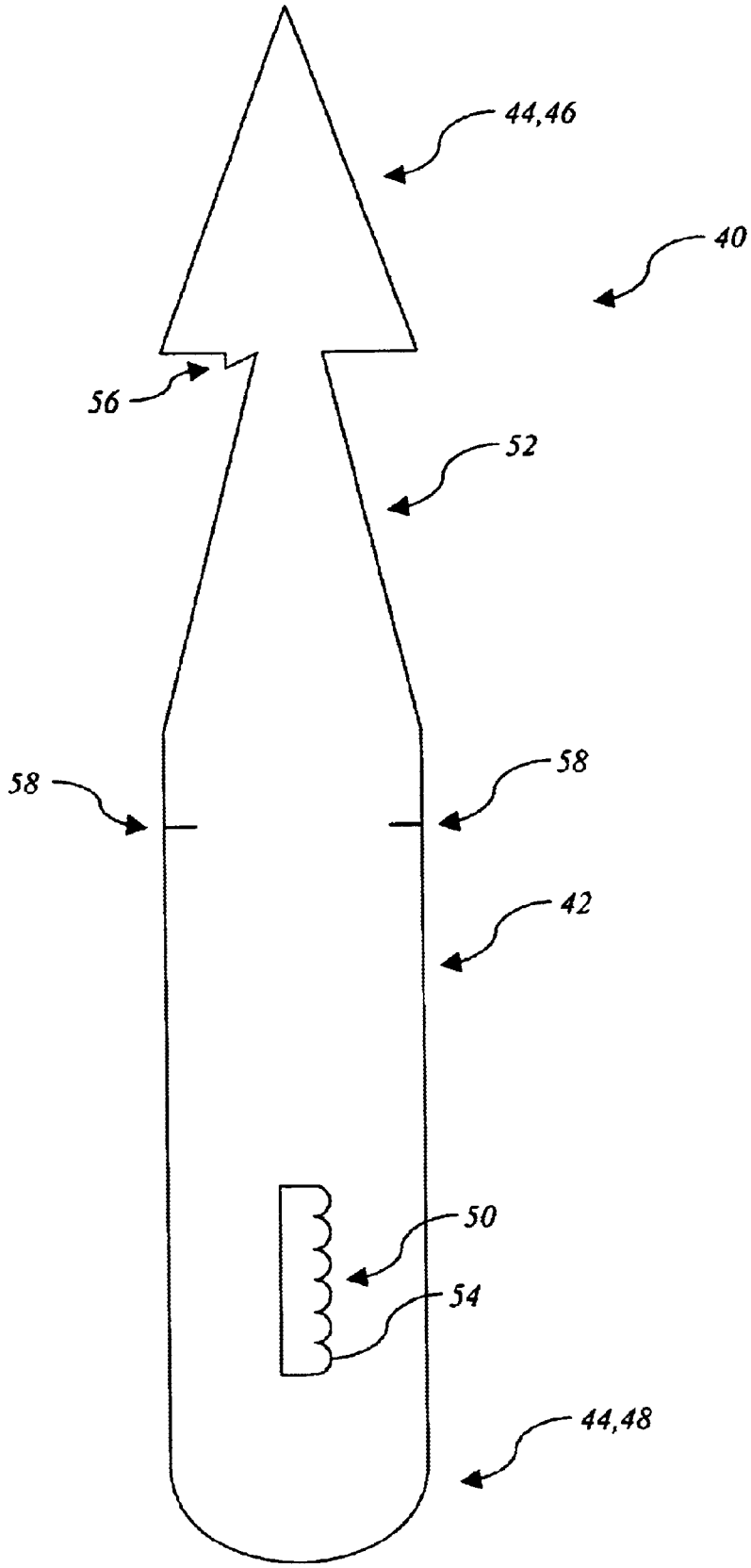
FIG. 3 is a top view of another embodiment of the pick of the present invention for use as a thumb pick.

Referring to FIG. 3, in a further embodiment of the present invention, the thumb pick 40 has a center portion 42 and two end portions 44, including a thin head 46 and a thick head 48. The thin head 46 has a relatively low rigidity, making it especially suitable for strumming the strings of an instrument. The thick head 48 has a relatively high rigidity, making it especially suitable for plucking or picking the strings of the instrument. The thin head 46 has a substantially triangular shape and the thick head 48 has a substantially rounded shape, although other suitable shapes can be utilized. The shapes of the thin head 46 and the thick head 48 preferably contribute to their rigidity. The thin head 46 and the thick head 48 can have a substantially uniform thickness or, alternatively, can taper along their length and/or width.

The center portion 42 has a substantially rectangular shape, although another suitable shape can be utilized. The center portion 42 is configured to be positioned about the tip of a player's thumb and, accordingly, includes a receiving slot 50. The receiving slot 50 is operable for receiving the thin head 46 of the thumb pick 40, forming a ring-like portion (not shown) configured to be positioned about the tip of the player's thumb. A neck portion 52 of the thumb pick 40, disposed between the center portion 42 and the thin head 46, is preferably sufficiently flexible that the thin head 46 can be twisted or cammed and inserted in and through the receiving slot 50. Preferably, the neck portion 52 tapers width-wise from the center portion 42 to the thin head 46. The receiving slot 50 includes a plurality of notches 54, allowing the diameter or size of the ring-like portion to be adjusted such that the ring-like portion can be positioned about the tip of any player's thumb. The thin head 46 includes a tab 56 operable for securing the thin head 46 in the receiving slot 50. Optionally, the center portion 42 of the thumb pick 40 also includes a plurality of tension slits 58, enhancing the ring-like portion's ability to engage the player's thumb when positioned thereupon. Advantageously, the configuration of the thin head 46 and the receiving slot 50, and their engagement method, allow the ring-like portion to snugly engage any thumb upon which the thumb pick 40 is positioned when the strings of the instrument are strummed, plucked, or picked.

The center portion 42, the thin head 46, the thick head 48, and the neck portion 52 can be separate components fixedly attached to one another, or they may be integrally formed. The center portion 42, the thin head 46, the thick head 48, and the neck portion 52 can be made of plastic, metal, or any other suitable material. Optionally, the center portion 42, the thin head 46, the thick head 48, and the neck portion 52 can be made of a self-lubricating material. The center portion 42, the thin head 46, the thick head 48, and the neck portion 52 can have a thickness of between about 0.01 inches and 0.10 inches, however, other suitable dimensions can be utilized.

Advantageously, the ring-like portion of the thumb pick 40 allows the thumb pick 40 to be held with a relatively low pressure. The ring-like portion also allows for a rapid transition between strumming with the thin head 46, plucking or picking with the thick head 48, and finger picking. Specifically, the thumb pick 40 may be spun about the tip of the player's thumb, or removed and repositioned about the tip of the player's thumb. The ring-like portion also allows the thumb pick 40 to be attached to the strings of an instrument when not in use, such that it will not be lost. As described above, the thumb pick 40 has an adjustable flex point, providing consistent pick-to-string contact, and can be made of a self-lubricating material, providing relatively low string wear and relatively high pick life. Optionally, a conventional pick or plectrum can be fixedly attached to the thin head 46 and/or the thick head 48 of the thumb pick 40.

Figure 4:
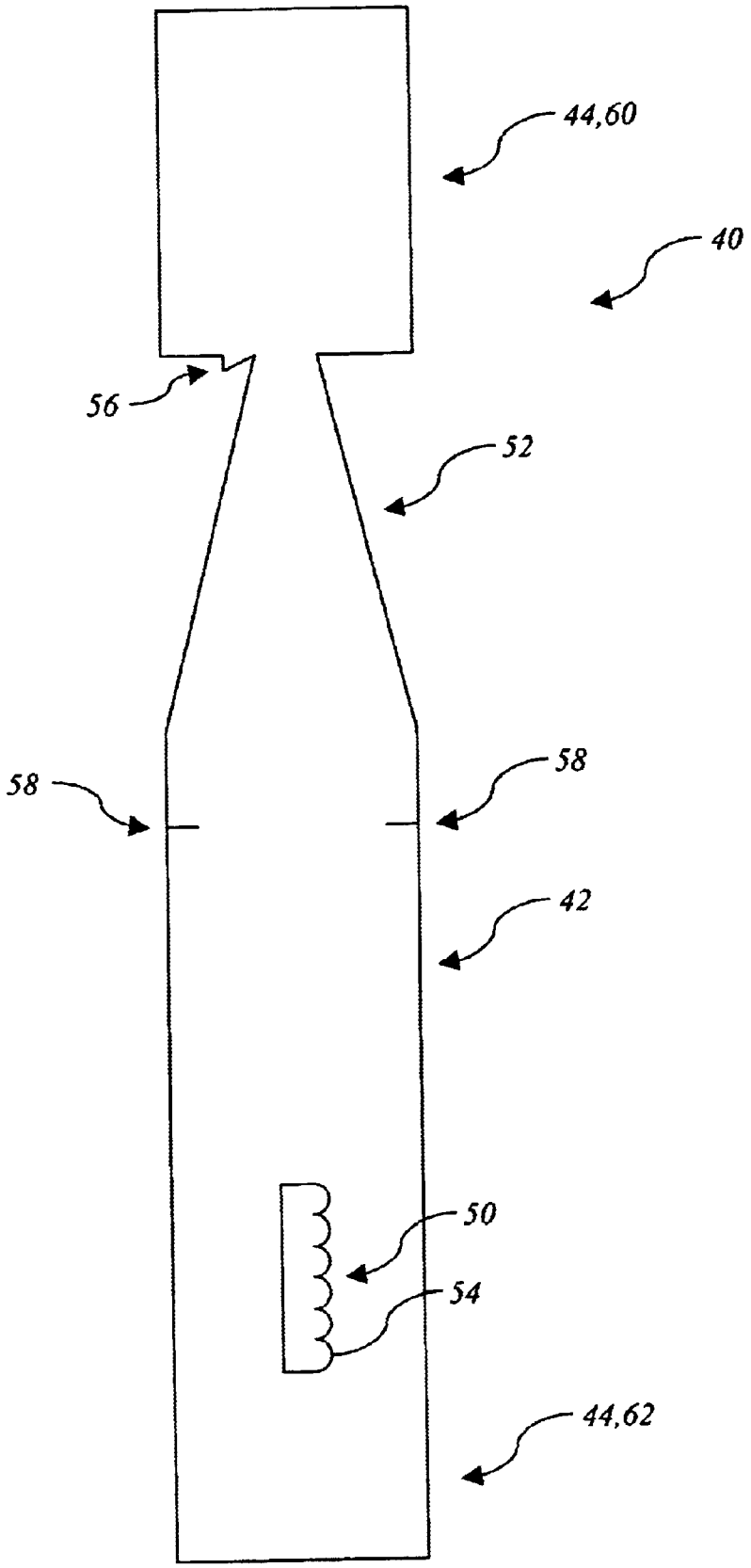
FIG. 4 is a top view of another embodiment of the pick of the present invention for use as a thumb pick.

Referring to FIG. 4, in a further embodiment of the present invention, the thumb pick 40 has a center portion 42 and two end portions 44, including a thin head end 60 and a thick head end .62. The thin head end 60 has a relatively low rigidity, making it especially suitable for strumming the strings of an instrument. The thick head end 62 has a relatively high rigidity, making it especially suitable for plucking or picking the strings of the instrument. The thin head end 60 and the thick head end 62 have a substantially rectangular shape, although other suitable shapes can be utilized. Advantageously, the thin head end 60 and the thick head end 62 can be trimmed by a player or customized with respect to shape. The eventual shapes of the thin head end 60 and the thick head end 62 preferably contribute to their rigidity. The thin head end 60 and the thick head end 62 can have a substantially uniform thickness or, alternatively, can taper along their length and/or width.

The center portion 42 has a substantially rectangular shape, although another suitable shape can be utilized. The center portion 42 is configured to be positioned about the tip of a player's thumb and, accordingly, includes a receiving slot 50. The receiving slot 50 is operable for receiving the thin head end 60 of the thumb pick 40, forming a ring-like portion (not shown) configured to be positioned about the tip of the player's thumb. A neck portion 52 of the thumb pick 40, disposed between the center portion 42 and the thin head end 60, is preferably sufficiently flexible that the thin head end 60 can be twisted or cammed and inserted in and through the receiving slot 50. Preferably, the neck portion 52 tapers width-wise from the center portion 42 to the thin head end 60. The receiving slot 50 includes a plurality of notches 54, allowing the diameter or size of the ring-like portion to be adjusted such that the ring-like portion can be positioned about the tip of any player's thumb. The thin head end 60 includes a tab 56 operable for securing the thin head end 60 in the receiving slot 50. Optionally, the center portion 42 of the thumb pick 40 also includes a plurality of tension slits 58, enhancing the ring-like portion's ability to engage the player's thumb when positioned thereupon. Advantageously, the configuration of the thin head end 60 and the receiving slot 50, and their engagement method, allow the ring-like portion to snugly engage any thumb upon which the thumb pick 40 is positioned when the strings of the instrument are strummed, plucked, or picked.

The center portion 42, the thin head end 60, the thick head end 62, and the neck portion 52 can be separate components fixedly attached to one another, or they may be integrally formed. The center portion 42, the thin head end 60, the thick head end 62, and the neck portion 52 can be made of plastic, metal, or any other suitable material. Optionally, the center portion 42, the thin head end 60, the thick head end 62, and the neck portion 52 can be made of a self-lubricating material. The center portion 42, the thin head end 60, the thick head end 62, and the neck portion 52 can have a thickness of between about 0.01 inches and 0.10 inches, however, other suitable dimensions can be utilized.

As described above, the ring-like portion of the thumb pick 40 allows the thumb pick 40 to be held with a relatively low pressure. The ring-like portion also allows for a rapid transition between strumming with the thin head end 60, plucking or picking with the thick head end 62, and finger picking. Specifically, the thumb pick 40 may be spun about the tip of the player's thumb, or removed and repositioned about the tip of the player's thumb. The ring-like portion also allows the thumb pick 40 to be attached to the strings of an instrument when not in use, such that it will not be lost. Again, the thumb pick 40 has an adjustable flex point, providing consistent pick-to-string contact, and can be made of a self-lubricating material, providing relatively low string wear and relatively high pick life.

Although the pick of the present invention has been described with reference to preferred embodiments and examples thereof, other embodiments and examples can achieve the same results. Variations in and modifications to the pick of the present invention will be apparent to those of ordinary skill in the art and the following claims are intended to cover all such equivalent embodiments and examples.

What is claimed is:

1. A pick device for playing a stringed musical instrument, the pick device comprising:

a center portion, wherein the center portion is configured to be positioned about a tip of a finger of a player in a ring-like configuration;

a head portion coupled to the center portion, wherein the head portion is suitable for strumming and plucking/picking strings of the instrument;

a tail portion coupled to the center portion; and a receiving slot disposed within the center portion, wherein the receiving slot is configured to adjustably receive the tail portion.

2. The pick device of claim 1, wherein the center portion, the head portion, and the tail portion are integrally formed.

3. The pick device of claim 1, wherein the center portion further comprises a first elongate portion and a second elongate portion.

4. The pick device of claim 1, wherein the center portion further comprises a tapering portion.

5. The pick device of claim 1, wherein the receiving slot comprises a plurality of notches configured to adjustably receive the tail portion.

6. The pick device of claim 1, wherein the tail portion is partially twisted and passes substantially through the receiving slot to adjustably engage the center portion.

7. The pick device of claim 1, wherein the head portion comprises a substantially triangular-shaped portion.

8. The pick device of claim 1, wherein the tail portion comprises a substantially rectangular-shaped portion.

9. The pick device of claim 1, wherein the shape of the head portion is customizable.

10. The pick device of claim 1, wherein the tail portion comprises a tab configured to secure the tail portion in the receiving slot.

11. The pick device of claim 1, wherein the center portion, the head portion, and the tail portion comprise a material selected from the group consisting of plastic, metal, and a self-lubricating material.

12. A pick device for playing a stringed musical instrument, the pick device comprising:

a center portion, wherein the center portion is configured to be positioned about a tip of a thumb of a player in a ring-like configuration;

a first end portion coupled to the center portion, wherein the first end portion is suitable for strumming and plucking/picking strings of the instrument;

a second end portion coupled to the center portion, wherein the second end portion is suitable for strumming and plucking/picking strings of the instrument;

a receiving slot disposed within the center portion, wherein the receiving slot is configured to adjustably receive the first end portion.

13. The pick device of claim 12, wherein the center portion, the first end portion, and the second end portion are integrally formed.

14. The pick device of claim 12, wherein the receiving slot comprises a plurality of notches configured to adjustably receive the first end portion.

15. The pick device of claim 12, wherein the first end portion is partially twisted and passes substantially through the receiving slot to adjustably engage the center portion.

16. The pick device of claim 12, wherein the first end portion comprises a substantially triangular-shaped portion.

17. The pick device of claim 12, wherein the second end portion comprises a substantially round-shaped portion.

18. The pick device of claim 12, wherein the shape of the first end portion is customizable.

19. The pick device of claim 12, wherein the shape of the second end portion is customizable.

20. The pick device of claim 12, further comprising a neck portion disposed between the center portion and the first end portion, wherein the neck-portion tapers width-wise from the center portion to the first end portion.

21. The pick device of claim 12, further comprising a plurality of tension slits disposed within the center portion, wherein the plurality of tension slits are configured to provide the center portion with flexibility.

22. The pick device of claim 12, wherein the first end portion comprises a tab configured to secure the first end portion in the receiving slot.

23. The pick device of claim 12, wherein the center portion, the first end portion, and the second end portion comprise a material selected from the group consisting of plastic, metal, and a self-lubricating material.

* * * * *